US012209419B2

(12) United States Patent
Delestre

(10) Patent No.: US 12,209,419 B2
(45) Date of Patent: Jan. 28, 2025

(54) APPLICATION HEAD FOR A TAPE APPLICATOR, TAPE APPLICATOR PROVIDED WITH SUCH A HEAD

(71) Applicant: ÉTABLISSEMENTS PIERRE GRÉHAL ET CIE SA, Baillet en France (FR)

(72) Inventor: Lionel Delestre, Beaumont-sur-Oise (FR)

(73) Assignee: ETABLISSEMENTS PIERRE GREHAL ET CIE S.A. (FR)

( * ) Notice: Subject to any disclaimer, the term of this patent is extended or adjusted under 35 U.S.C. 154(b) by 272 days.

(21) Appl. No.: 17/608,485

(22) PCT Filed: Jun. 4, 2019

(86) PCT No.: PCT/FR2019/000085

§ 371 (c)(1),
(2) Date: Nov. 3, 2021

(87) PCT Pub. No.: WO2020/245509

PCT Pub. Date: Dec. 10, 2020

(65) Prior Publication Data

US 2022/0220750 A1 Jul. 14, 2022

(51) Int. Cl.
*E04F 21/02* (2006.01)
*E04F 21/165* (2006.01)

(52) U.S. Cl.
CPC ..... *E04F 21/026* (2013.01); *E04F 21/1655* (2013.01); *E04F 21/1657* (2013.01)

(58) Field of Classification Search
CPC .. E04F 21/026; E04F 21/1655; E04F 21/1657
See application file for complete search history.

(56) References Cited

U.S. PATENT DOCUMENTS

| | | | | |
|---|---|---|---|---|
| 4,196,028 A | | 4/1980 | Mills et al. | |
| 5,114,527 A | | 5/1992 | Stern et al. | |
| 6,136,118 A | * | 10/2000 | Bartholomew | B65B 13/327 156/580.2 |

FOREIGN PATENT DOCUMENTS

| | | | | |
|---|---|---|---|---|
| FR | 3007439 | | 12/2014 | |
| WO | 2011/094820 | | 8/2011 | |
| WO | WO-2014202853 A1 | * | 12/2014 | E04F 21/00 |

* cited by examiner

*Primary Examiner* — George R Koch
(74) *Attorney, Agent, or Firm* — Christopher W. Brody

(57) ABSTRACT

An application head for an applicator for applying jointing tape between two plaster boards includes a fixing core and two sides receiving two rotation shafts parallel to each other, two notched rollers being carried by the first rotation shaft, and two link rods being mounted so as to be able to pivot on the second rotation shaft, one end of each link rod being mounted so as to be able to rotate freely on a third rotation shaft, to either side of a corner roller. The application head also includes a spring comprising two legs bearing against the fixing core, extended by an elbow linked to a blocking arm provided with a notch for immobilizing the link rods in the use position, the blocking arms being linked together by a return hoop and reversible blocking mechanism for immobilizing the link rods in the retracted position, separate from the spring.

16 Claims, 5 Drawing Sheets

[Fig. 1]
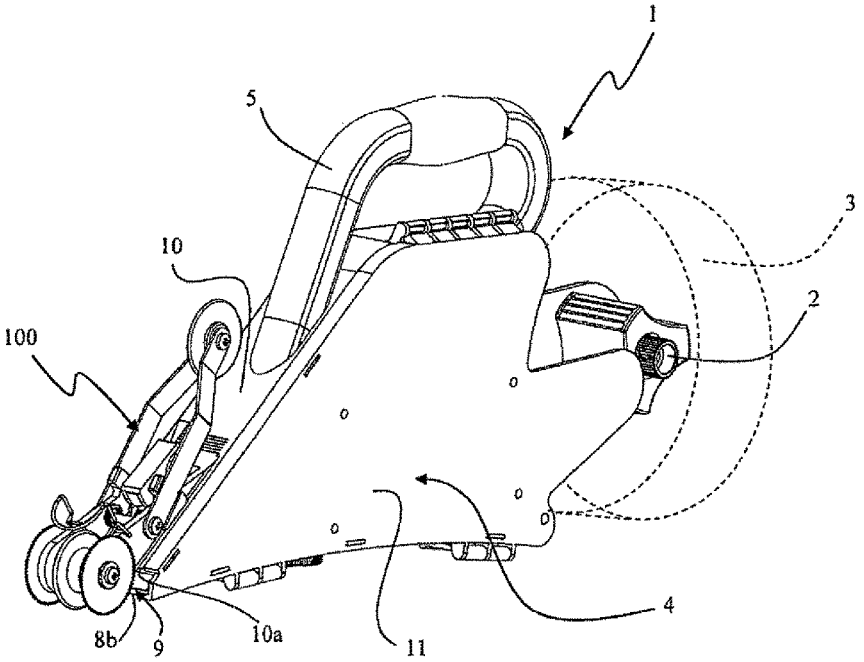
[Fig. 2]
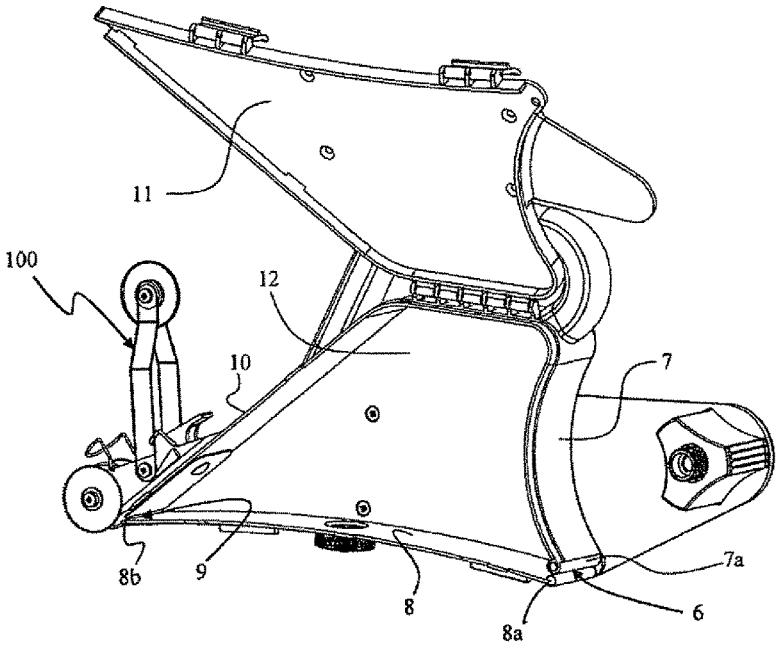

[Fig. 3]
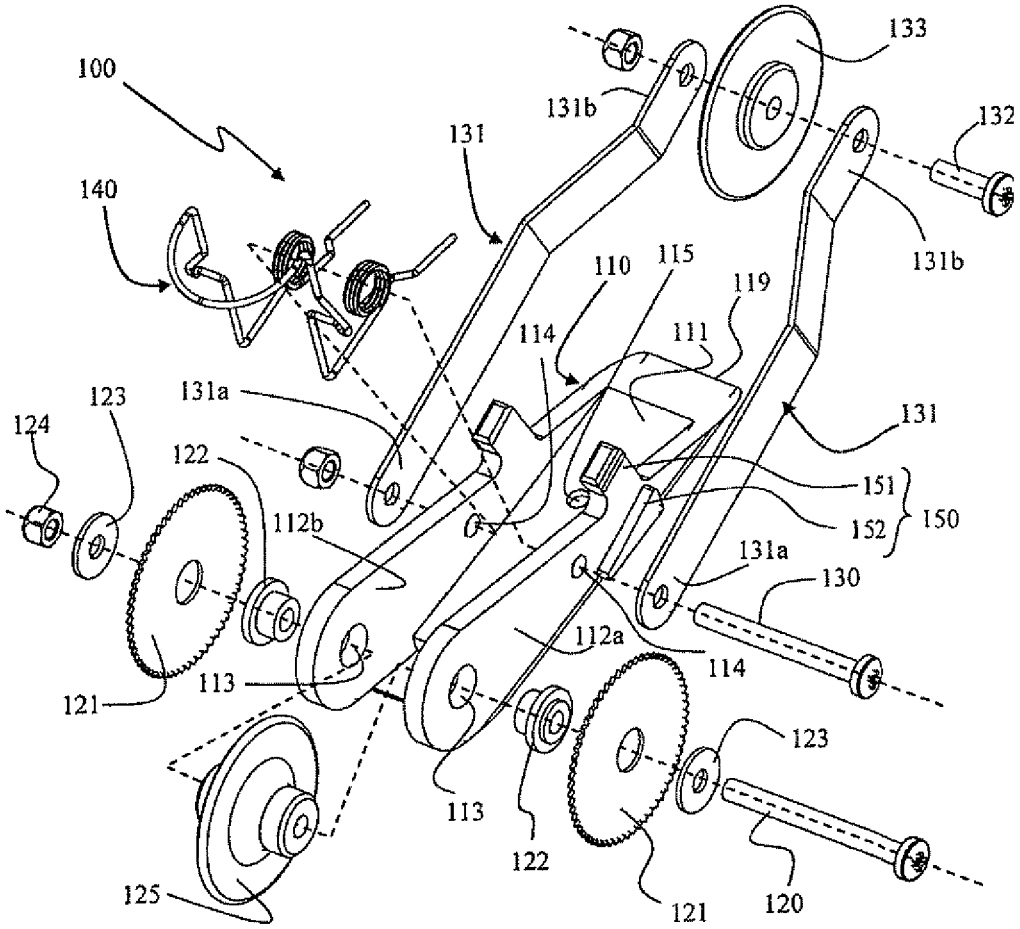
[Fig. 4]
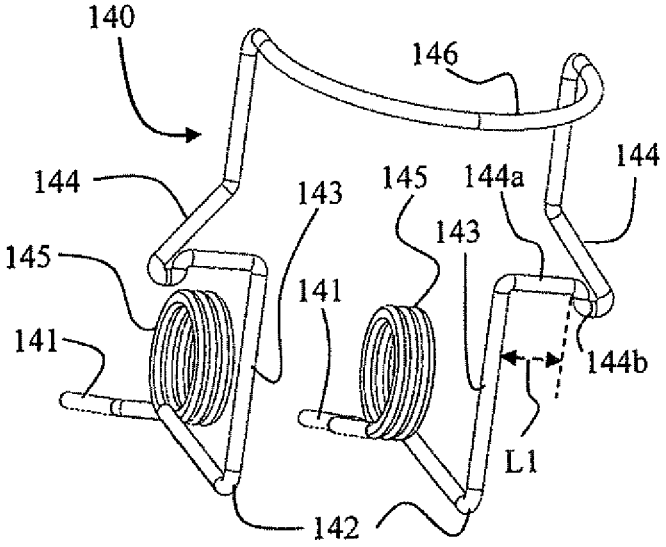

[Fig. 5]
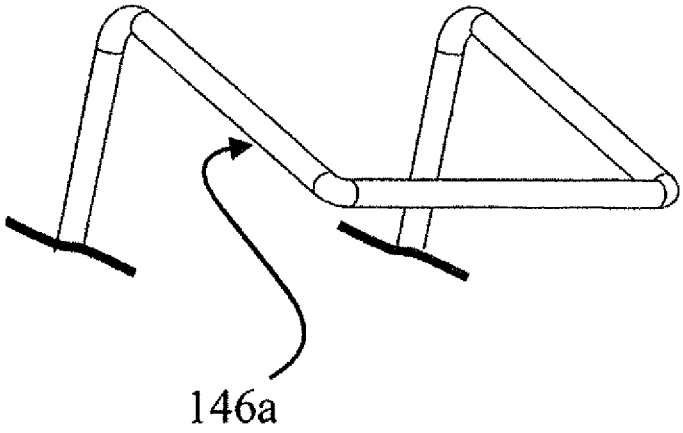
[Fig. 6]
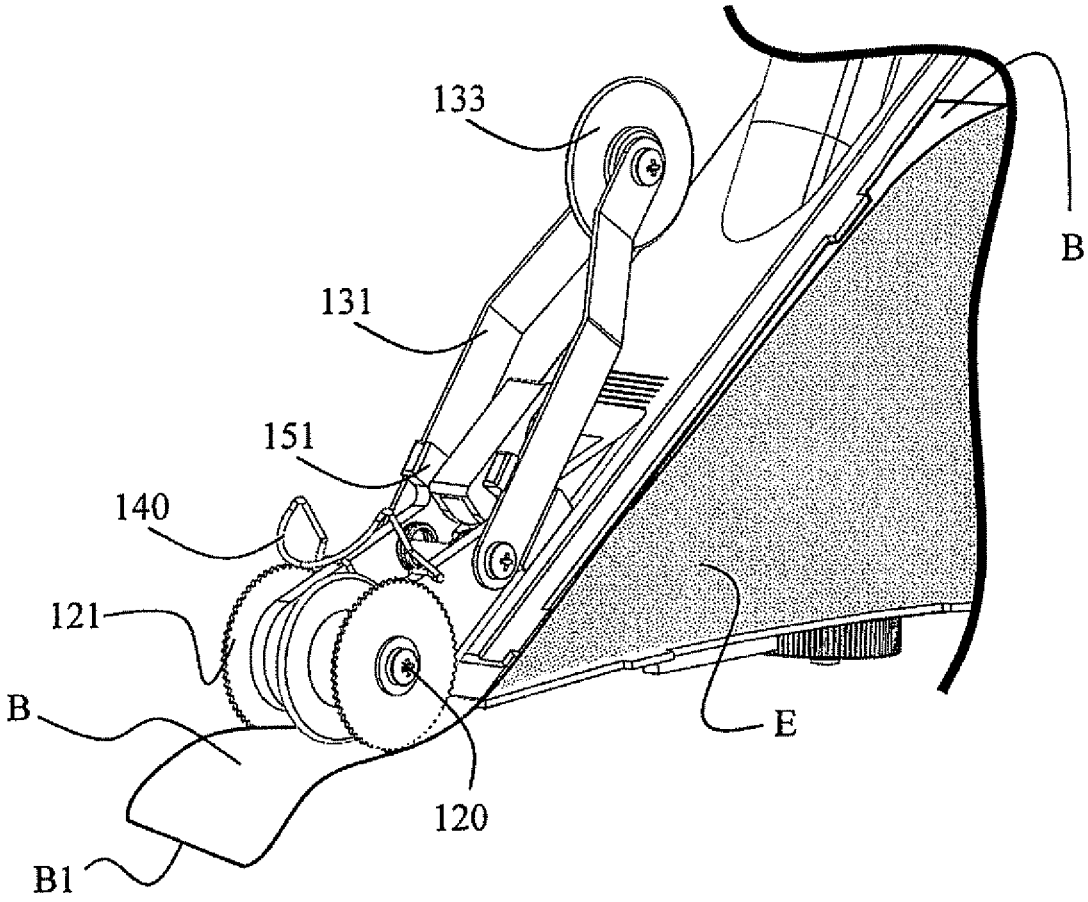

[Fig. 7]
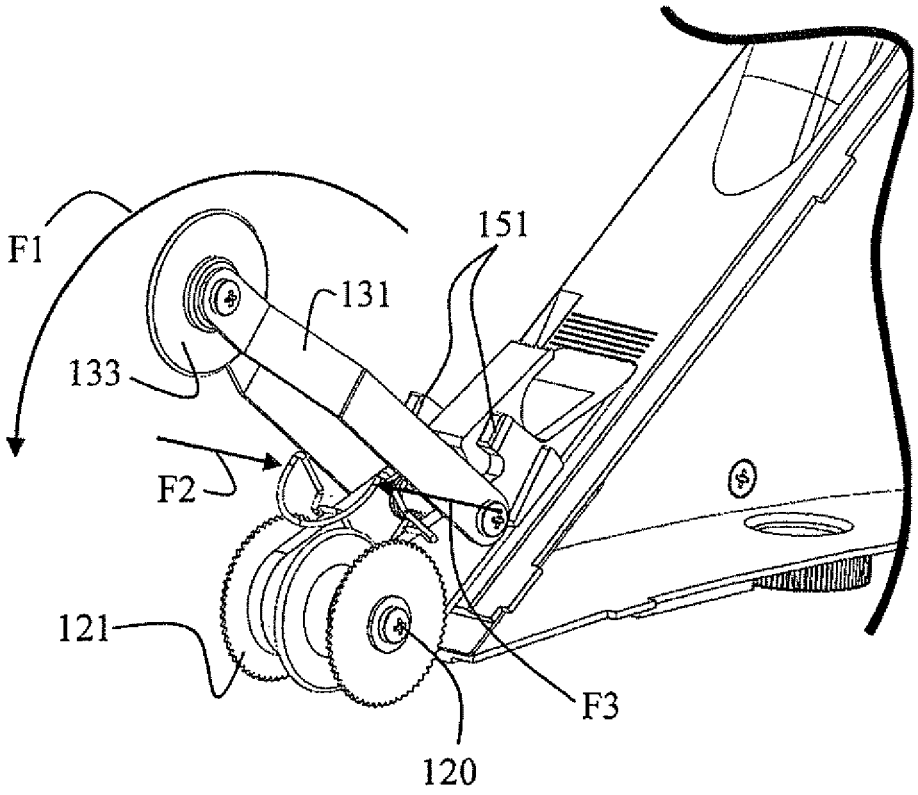
[Fig. 8]
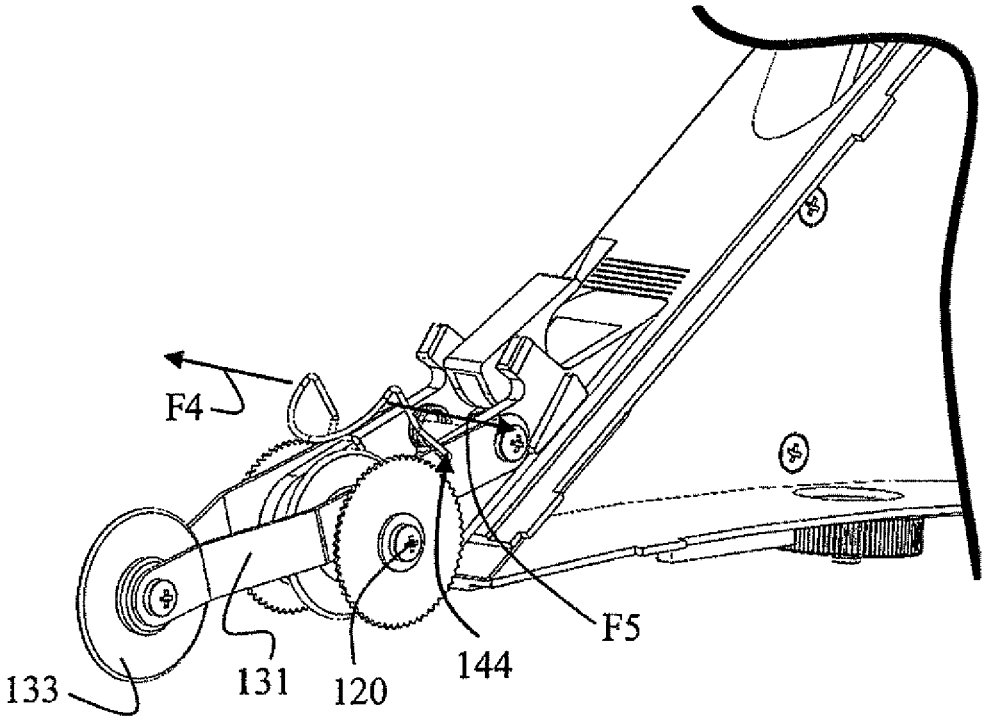

[Fig. 9]
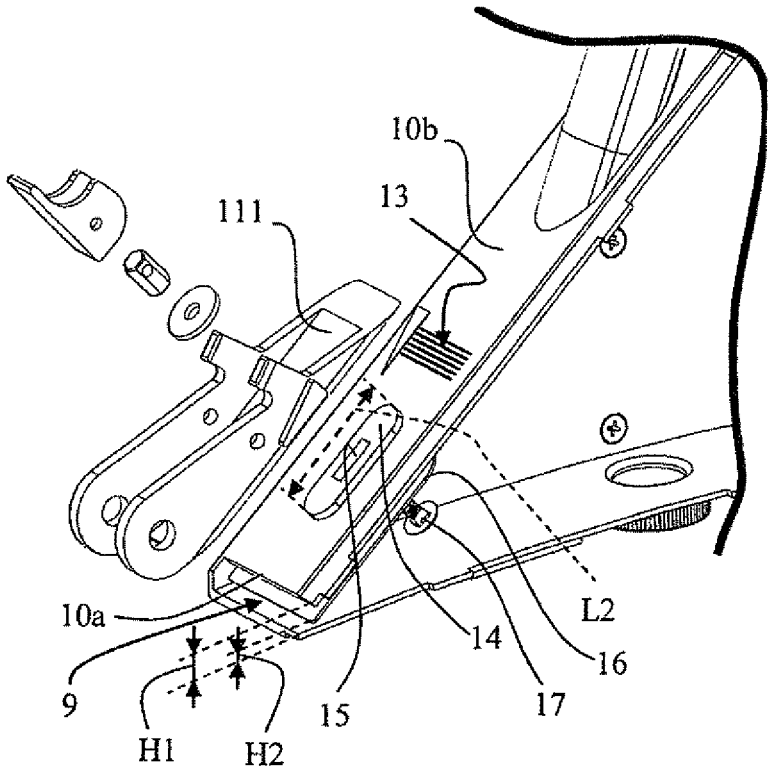
[Fig. 10]
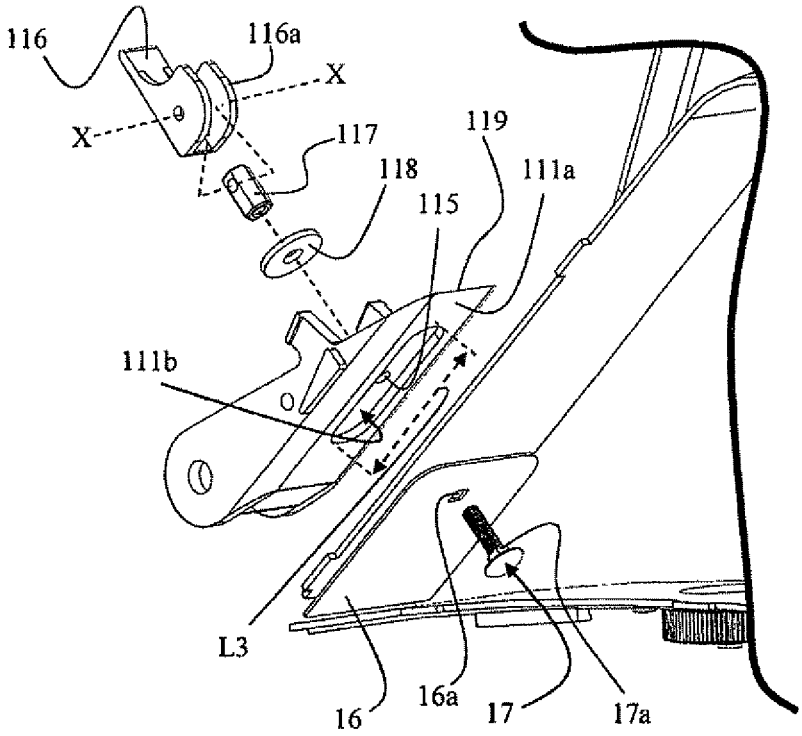

APPLICATION HEAD FOR A TAPE APPLICATOR, TAPE APPLICATOR PROVIDED WITH SUCH A HEAD

This application is 371 of PCT/FR2019/000085, filing date Jun. 4, 2019.

The present invention relates to an application head for an applicator of jointing tape for joining two sheets of plasterboard.

Such an applicator is intended for laying a tape made of paper or similar material, that comes in the form of a roll, between two adjacent sheets of plasterboard, during building or renovation work, using a pasty jointing compound known as mud.

Thus, the mud fills the space between the two sheets and the tape holds them together.

The tape is laid along two sheets positioned in one and the same plane or at a corner-forming angle. Once the mud and the tape are in position, the user smooths them using a flat spatula, or a corner spatula for the corners. The tape thus makes it possible to obtain a perfectly smooth join between the sheets.

Tape applicators commonly known as taping "banjos" are already known, these comprising a mud chamber and a payout device for paying out a jointing tape from a roll to perform numerous jointing operations, particularly on large jobs.

To this end, the chamber has, by reference to the position of use, a rear wall delimiting a tape inlet slot and a frontal wall delimiting a tape outlet slot.

An application head is generally intended to be attached to the frontal wall above the outlet slot to ensure correct application of the tape, namely to extract the mud-laden tape from the applicator and press the tape onto the sheets of plasterboard. The user then performs a finishing smoothing operation using a spatula.

Document WO2011094820 describes an application head configured to apply a tape between two sheets of plasterboard that are at a corner-forming angle to one another. The head comprises a mounting plate for fixing to the applicator, the mounting plate being extended by a fixed arm supporting a corner wheel of V-shaped profile to press the tape into a corner.

This head has numerous disadvantages. Specifically, it is suitable only for applying tape in a corner, which means that it has to be removed so that an application head suitable for applying tape flat can be refitted. Two distinct heads are therefore needed, and this is time-consuming and comes with the risk that one of the two heads may become lost.

Furthermore, the mounting plate is intended to be fixed inside the chamber and to collaborate with a shank of an external adjusting screw fitted with an eccentric and that is used not only for attaching the mounting plate but also for adjusting its position along the chamber in order to regulate the height of the tape outlet slot as illustrated in document US511427. The mounting plate and the adjusting mechanism are therefore directly in contact with the mud, and this fouls and damages the mechanism because it is necessary to force it in order to adjust the height of the slot. Furthermore, because the application head delimits the upper edge of the slot, the entirety of the head has to be changed regularly because the upper edge of the slot is subjected to a great deal of abrasion and to very high temperatures with repeated passage of the tape.

It is therefore an objective of the present invention to propose an application head that is multifunctional, namely able to apply the tape flat and apply it to corners, without needing to be removed between the two functions (of applying the tape flat and applying it to a corner) and without needing to be changed as a result of the wear created by the tape.

Document FR3007439 describes a multifunction application head which also has the advantage of not requiring removal between the two functions (applying the tape flat and applying it to a corner).

However, this application head is complex and its structure also does not allow the heightwise adjustment of the tape outlet slot.

Specifically, the application head comprises a mounting plate comprising a fixing web equipped with means for fixing the application head against the frontal wall of the chamber, and two flanks perpendicular to the fixing web and each having two orifices, facing each other in pairs, to receive a first rotation spindle and a second rotation spindle, which spindles are mutually parallel.

The application head also comprises two toothed wheels for driving the tape that are borne by the first rotation spindle, and two link rods mounted to rotate freely, on the second rotation spindle, between a retracted position and a position of use. A second end of each link rod is mounted to rotate freely on a third rotation spindle, on either side of a corner wheel.

The link rods are held elastically in the retracted position and in the position of use by two independent springs each one comprising an upstream arm (closest to the mounting plate) and a downstream arm (pressing elastically on the first rotation spindle bearing the toothed wheels).

For the corner wheel to pass from the retracted position to the position of use, these springs need to be deactivated and then activated in a complicated way. Specifically, the upstream arms of the springs have first of all to be disengaged one by one from the link rods and the downstream arms of the springs have to be moved one by one from the outside of the toothed wheels to the inside of the toothed wheels, this representing four actions. The link rods are then pivoted into contact with the first rotation spindle in order to bring the corner wheel into the position of use. The downstream arms of the springs are then activated one by one by positioning them against the link rods, and the upstream arms of the springs are activated one by one by positioning them against the flanks, this again representing four actions. A total of nine actions is therefore required in order to switch from the retracted position to the position of use, all the while handling small components, something which is not easy to do on a work site with mud-covered hands. Correspondingly, the risks of fouling the elastic retaining components of the head are great.

It is an objective of the present invention to propose an application head that provides simple dynamics and manipulations for switching from the retracted position to the position of use without the need to remove the entire head.

According to the invention, the function of maintaining a retracted position and the function of elastically maintaining a position of use are performed by two independent structures, allowing the switch between the two positions to be achieved in just three operations while at the same time very greatly limiting the risks of the elastic retention parts becoming fouled.

Thus, one subject of the invention is an application head for an applicator of jointing tape for joining two sheets of plasterboard, the applicator comprising a payout device for paying out a jointing tape that comes in a roll and a mud chamber through which the tape is paid out, in use, the chamber having, with reference to the position of use, a tape inlet slot formed between a free end of a rear wall of the chamber and a first free end of a lower wall of the chamber, and a tape outlet slot formed between a free end of a frontal wall of the chamber and a second free end of the lower wall of the chamber, the chamber further comprising two lateral walls, one of which constitutes a removable side cover providing access to the inside of the chamber, the application head being intended to be fixed to the frontal wall above the outlet slot, the application head comprising:

a mounting plate comprising a fixing web equipped with means for fixing the application head against the frontal wall of the chamber, and two flanks perpendicular to the fixing web and each having two orifices, facing each other in pairs, to receive a first rotation spindle and a second rotation spindle, which spindles are mutually parallel, two toothed wheels for driving the tape that are borne by the first rotation spindle;

two link rods being mounted via a first end to rotate freely, on the second rotation spindle, between a retracted position and a position of use, a second end of each link rod being mounted to rotate freely on a third rotation spindle, on either side of a corner wheel, itself free to rotate on the third rotation spindle;

the application head according to the invention comprising:

a spring having two legs bearing against the mounting plate, each bearing leg being extended by a bend connected to an immobilizing arm equipped with a catch for immobilizing the link rods in the position of use, the immobilizing arms extending in a plane secant to a plane passing through the two bearing legs, the immobilizing arms being joined together by a return arch extending in a plane secant to the plane passing through the two immobilizing arms reversible immobilization means independent of the spring, for immobilizing the link rods in the retracted position.

According to particular embodiments:

the immobilization means may comprise at least one immobilization claw and at least one end stop configured so that, in the immobilization position, at least one link rod is kept pressed against the end stop by the claw;

the claws and/or the link rods may be configured to allow the link rods to be forcibly unlocked from the claws the immobilization means may comprise an immobilization orifice and an immobilization pin intended to be inserted removably into the immobilization orifice;

wherein the return arch may be chosen from straight arches or curved arches;

the immobilization catches may comprise a lateral locking loop to lock the link rods laterally in the position of use;

the application head being intended to be fixed against an exterior contact face of the frontal wall of the chamber, in the fixed position, the contact face comprising a sliding guide equipped with an oblong orifice, the chamber further comprising a tape outlet slot, a plate for adjusting the height of said outlet slot, said plate being arranged inside the chamber, and a plate coupling and clamping spindle, the spindle being engaged in an orifice of the plate and in the oblong hole of the sliding guide, the fixing web of the application head may comprise a bearing face intended to bear against the contact face of the frontal wall of the chamber, in the fixed position, the bearing face of the fixing web bearing a sliding end stop equipped with a central hole through which the coupling and clamping spindle is intended to pass, and wherein the means for fixing the application head against the frontal wall of the chamber are able to collaborate with the coupling and clamping spindle to allow the fixing web to be clamped against the frontal wall of the chamber, or loosened therefrom;

the fixing means may comprise a quick clamp lever comprising a cam fixed in a pivoting and eccentric manner to a coupling member intended to be fixed to the coupling and clamping spindle;

the sliding end stop borne by the bearing face of the fixing web may consist of an oblong groove intended to collaborate with the sliding guide borne by the contact face of the frontal wall of the chamber, the sliding guide being an oblong rib; and/or the sliding end stop borne by the bearing face of the fixing web may consist of an oblong rib intended to collaborate with the sliding guide borne by the contact face of the frontal wall of the chamber, the sliding guide being an oblong groove.

Another subject of the invention is a spring for an abovementioned application head, the spring comprising two legs bearing against the mounting plate, each bearing leg being extended by a bend connected to an immobilizing arm equipped with a catch for immobilizing the link rods in the position of use, the immobilizing arms extending in a plane secant to a plane passing through the two bearing legs, the immobilizing arms being joined together by a return arch extending in a plane secant to the plane passing through the two immobilizing arms.

According to particular embodiments:

the return arch may be chosen from straight arches or curved arches; and/or the immobilization catches may comprise a lateral locking loop to lock the link rods laterally in the position of use.

Another subject of the invention is an applicator of jointing tape between two sheets of plasterboard, the applicator comprising a payout device for paying out a jointing tape that comes in a roll and a mud chamber through which the tape is paid out, in use, the chamber having, with reference to the position of use, a rear wall delimiting a tape inlet slot, and a frontal wall delimiting a tape outlet slot, characterized in that the frontal wall of the chamber bears an abovementioned application head.

According to particular embodiments:

the frontal wall of the chamber may comprise an exterior contact face for contact with a bearing face of the application head, the contact face bearing a sliding guide equipped with an oblong orifice, the chamber further comprising a plate for adjusting a height of the outlet slot, said plate being arranged inside the chamber, and a plate coupling and clamping spindle, the spindle being engaged in an orifice in the plate and in the oblong hole of the sliding guide, wherein the bearing face of the fixing web bears a sliding end stop equipped with a central hole through which the coupling and clamping spindle passes, and wherein the means for fixing the application head against the frontal wall of the chamber collaborate with the coupling and clamping spindle to allow the mounting plate and the adjusting plate to be clamped against the frontal wall of the chamber, or loosened therefrom;

the fixing means may comprise a quick clamp lever comprising a cam fixed in a pivoting and eccentric manner to a coupling member fixed to the coupling and clamping spindle;

the sliding end stop borne by the bearing face of the fixing web may consist of an oblong groove collaborating in sliding with the sliding guide borne by the contact face of the frontal wall of the chamber, the sliding guide being an oblong rib; and/or the sliding end stop borne by the bearing face of the fixing web may consist of an oblong rib collaborating in sliding with the sliding guide borne by the contact face of the frontal wall of the chamber, the sliding guide being an oblong groove.

Another subject of the invention is a method for applying a jointing tape between two adjacent sheets of plasterboard making an angle between them, the method comprising the following steps:

a) providing an abovementioned jointing-tape applicator, the chamber of the applicator being filled with compound and the tape being ready for use and comprising a free end protruding from the tape outlet slot;

b) if the link rods bearing the corner wheel are in the retracted position, deactivating the link rod fixing means so that they can be pivoted toward the first rotation spindle;

c) squeezing the spring by applying a squeezing force between the two arms of the spring and at the level of the return arch so as to allow the link rods to pivot until they come to bear against the first rotation spindle;

d) positioning the spring arm immobilization catches above the link rods then releasing the spring so that the link rods are in the position of use, returned elastically toward the first pivot spindle;

e) pressing the free end of the tape against the two adjacent sheets of plasterboard, in the corner formed by the two sheets of plasterboard, then pressing the head of the applicator against the two sheets of plasterboard so that the drive wheels press the tape against the sheets;

f) moving the applicator along so that the drive wheels drive the tape which is paid out, carrying mud out with it, and so that the corner wheel, borne by the link rods in the position of use, presses the tape into the corner in all positions of inclination of the applicator with respect to the sheets of plasterboard, by virtue of the elastic return of the link rods toward the first pivot spindle.

Further features of the invention will be stated in the following detailed description, given with reference to the attached drawings, which respectively depict:

FIG. 1 depicts a schematic perspective view of a tape applicator according to the invention in the position of use, namely in the position for applying a tape, and equipped with an application head according to the invention;

FIG. 2 depicts a schematic perspective rear view of the tape applicator of FIG. 1 and from which one of the lateral walls has been removed in order to show the internal structure of the applicator;

FIG. 3 depicts a schematic exploded perspective view of an application head according to the invention;

FIG. 4 depicts a schematic perspective view of a first embodiment of a spring for an application head according to the invention;

FIG. 5 depicts a schematic perspective view of a second embodiment of a spring for an application head according to the invention;

FIG. 6 depicts a schematic perspective view of an application head according to the invention, with the corner wheel in the retracted position;

FIG. 7 depicts a schematic perspective view of an application head according to the invention, with the corner wheel in the process of being deployed to the position of use;

FIG. 8 depicts a schematic perspective view of an application head according to the invention, with the corner wheel in the position of use;

FIG. 9 depicts a schematic exploded perspective view, from a first perspective, of a second embodiment of an application head according to the invention, further comprising a means for the heightwise adjustment of the tape outlet slot of the applicator according to the invention; and FIG. 10 depicts a schematic exploded perspective view, from a second perspective, of the embodiment of an application head of FIG. 8, showing the plate for the heightwise adjustment of the tape outlet slot.

An applicator equipped with an application head according to the invention is illustrated in FIG. 1.

The applicator 1 comprises a payout device 2 for paying out a roll 3 of jointing tape (illustrated in dotted line) and a mud chamber 4 through which the tape is paid out during use.

The applicator also comprises a holding handle 5 for transporting it or handling it operationally when applying the tape.

Alternatively or in combination, the applicator may comprise a carry strap (not illustrated) allowing the applicator to be picked up from beneath.

As illustrated in FIG. 2, the chamber 4 has, with reference to the position of use, a tape inlet slot 6 formed between a free end 7*a* of a rear wall 7 of the chamber and a first free end 8*a* of a lower wall 8 of the chamber.

The chamber 4 also has a tape outlet slot 9 formed between a free end 10*a* of a frontal wall 10 of the chamber and a second free end lib of the lower wall 8 of the chamber.

The chamber further comprising two lateral walls 11 and 12, one of which constitutes a removable side cover 11 providing access to the inside of the chamber 4.

An application head 100 according to the invention is fixed to the frontal wall 10 of the chamber 4.

The application head 100, illustrated in exploded perspective in FIG. 3, comprises a mounting plate 110 comprising a fixing web 111 and two flanks 112*a*-112*b* perpendicular to the fixing web 111. Each flank 112*a*-112*b* having two orifices 113-114 facing one another in pairs. Thus, the orifice 113 of the flank 112*a* faces the orifice 113 of the flank 112*b* to receive a first rotation spindle 120, and the orifice 114 of the flank 112*a* faces the orifice 114 of the flank 112*b* to receive a second rotation spindle 130. The rotation spindles 120 and 130 are mutually parallel.

The fixing web 111 is equipped with means 115 for fixing against the frontal wall 10 of the chamber, to fix the application head 100 to the chamber. In FIG. 3, these fixing means consist of at least one orifice 115 able to accept a screw (not illustrated) for fixing to the chamber. Alternatively, as described in connection with FIGS. 8 and 9, the fixing means may be more elaborate and also allow heightwise adjustment of the outlet slot, again by means of the orifice 115.

The first rotation spindle 120 bears two toothed wheels 121 for driving the tape as it is being applied. As a preference, the toothed wheels 121 are mounted with the freedom to rotate about the rotation spindle 120 and on the outside of the flanks 112*a*-112*b* by means of spacers 122. The assembly is held in position by means of washers 123 and a nut 124.

As a preference, the first rotation spindle 120 also bears a smooth pressing wheel 125 mounted to rotate freely between the two flanks 112*a*-112*b* and which serves to press the tape against the sheets of plasterboard.

The application head also comprises two link rods 131 mounted to rotate freely on the second rotation spindle via a first end 131*a*, between a retracted position (illustrated in FIG. 6) and a position of use (illustrated in FIG. 7).

A second end 131*b* of each link rod is mounted to rotate freely on a third rotation spindle 132, on either side of a corner wheel 133, itself free to rotate on the third rotation spindle 132. The corner wheel has a V-shaped rolling edge to press the tape onto sheets of plasterboard that form an angle between them.

According to the invention, the application head 100 comprises a spring 140 (illustrated in greater detail in FIG. 4) comprising two bearing legs 141 bearing against the mounting plate 111, each bearing leg 141 being extended by a bend 142 connected to an immobilizing arm 143 for immobilizing the link rods in the position of use, each immobilizing arm being equipped with an immobilizing catch 144.

The immobilizing arms 143 extend in a plane secant to a plane passing through the two bearing legs 141. As a preference, the arms are substantially perpendicular to the mounting plate 11, in the position of use.

The immobilizing catches have a bearing portion 144*a* to bear against the flanks 112*a*-112*b* or against the link rods 131, depending on the position—retracted position or position of use. The bearing portion is preferably perpendicular to the flanks 112*a*-112*b* or to the link rods 131, whereas the immobilizing arms 143 are substantially parallel to the flanks 112*a*-112*b* or to the link rods 131.

The bearing portion has a length greater than or equal to the sum of the thickness of the flanks 112*a*-112*b* and the thickness of the link rods 131.

In one advantageous embodiment, the immobilizing catches 144 comprise a lateral locking loop 144*b* for locking the link rods laterally in the position of use. The loop prevents any accidental lateral disengagement of the link rods in the position of use.

The loop 144*b* is situated at the outside end of the contact portion 144*a*. What is important is that the bearing portion has a length L1, measured between the arm 143 and the loop 144*b*, that is greater than or equal to the sum of the thickness of the flanks 112*a*-112*b* and the thickness of the link rods 131.

A coil of spring 145 is arranged between the free ends of the bearing legs 141 and the bends 142 for connecting to the arms 143. This coil 145 performs two functions simultaneously: an elastic return function which allows the entire part consisting of the portion of the legs connected to the bends 142, the bends 142, the arms 143 and the arch 146 to pivot together while the portion of the legs bearing their free end remains in contact with the mounting plate 111. The coil also houses the second rotation spindle 130, holding the spring in position and ensuring that the spring pivots about the rotation spindle 130.

Furthermore, the immobilizing arms 143 are joined together by a return arch 146 extending in a plane secant to the plane passing through the two immobilizing arms 143.

This return arch may be a curved arch (FIG. 4) or straight arch 146*a* (FIG. 5). It may be arranged toward the first rotation spindle 120 as illustrated in the figures. In that case, the spring takes the overall shape of an S when viewed in profile. The arch may also be arranged toward the second rotation spindle 130 (this is not illustrated), in which case the spring takes the overall shape of a C when viewed in profile.

The return arch 146 performs an unexpected return function which, when the spring is squeezed at said arch 146, ensures that the bends have a tendency to move closer to one another, allowing the immobilizing catches 144 to disengage from the flanks in order to allow the link rods 131 to pass during the transition between the retracted position and the position of use, and vice versa, as explained with reference to FIGS. 6 to 8. This also allows the bends 142 to be immobilized temporarily against the inside of the flanks 112*a*-112*b* during the transition between the retracted position and the position of use, thereby avoiding the need to hold the spring.

In the absence of the arch, the bends 142 have a tendency to move apart during squeezing, thereby preventing sufficient disengagement of the immobilizing catches 144 and additionally preventing them from being able to be inserted temporarily between the flanks 112*a*-112*b*.

According to the invention, the application head 100 according to the invention also comprises reversible immobilization means 150, independent of the spring, for reversibly immobilizing the link rods 131 in the retracted position.

One preferred embodiment is illustrated in FIG. 3 in which the immobilization means 150 comprise at least one immobilization claw 151 and at least one end stop 152 configured so that, in the immobilization position, at least one link rod is kept pressed against the end stop 152 by the claw 151.

The end stop 152 takes the form of a ramp, preventing the corner wheel 133 from being in contact with the chamber 4 in the retracted position. The claws 151 have a longitudinal portion 151*a* in the vertical continuation of the flanks 112*a*-112*b*, and a shoulder 151*b* that immobilizes and clamps the link rods against the end stop 152.

The claws 151 and/or the link rods 131 are configured to allow the link rods to be forcibly unlocked from the claws. Thus, when the user wishes to switch the link rods from the retracted position to the position of use, in the direction of the arrow F1 (FIG. 7), they force the link rods to disengage from the claws 151. This forcible unlocking is allowed through the elasticity of the link rods 131 and/or the elasticity of the claws (particularly the longitudinal portion 151*a*) which allow elastic deformation of the link rods and/or of the claws.

At the moment at which a tape is to be applied across two sheets that form an angle between them, it is necessary to ensure that the tape is properly pressed into the corner and against the sheets of plasterboard. For that, the corner wheel must be used.

Thus, in order to apply a jointing tape to join two adjacent sheets of plasterboard that make an angle between them, using an applicator equipped with an application head according to the invention, the following procedure, illustrated in FIGS. 6 to 8, is followed.

FIG. 6 illustrates an application head according to the invention in the retracted position, namely in the position in which the corner wheel is inactive and cannot come into contact with the tape. In other words, in this position, only the toothed wheels 121, and possibly the pressing wheel 125, are in contact with the tape. This position is the position used when the tape is to be applied to join two coplanar sheets of plasterboard.

In this figure, it may be seen that the chamber is full of mud E and that the tape B is in the position of use, namely positioned in contact with the mud in the chamber and that it has a free end B1 protruding from the outlet slot 9.

In the retracted position (FIG. 6), when the link rods 131 bearing the corner wheel 133 are in the retracted position, the link rod fixing means 150 are deactivated so that they can be pivoted in the direction of the arrow F1 toward the first rotation spindle 120 (FIG. 7). In the embodiment illustrated, the link rods are forced in the direction of the arrow F1 so that they are forcibly disengaged from the claws 151.

Once the link rods 131 have been released from the claws 151, the spring is squeezed by applying a squeezing force (illustrated by the arrows F2 and F3) between the two arms of the spring 140 and at the level of the return arch 145 in order to retract the immobilizing catches 144 towards the space situated between the two flanks 112*a*-112*b* and allow the link rods to pass and to pivot until they are bearing against the first rotation spindle 120.

The immobilizing catches 144 of the spring arms are then positioned above the link rods 131 then the spring is released (as illustrated by the arrows F4 and F5) so that the immobilizing catches are in elastic contact with the link rods and the latter are, in the position of use, elastically returned toward the first pivot spindle. More specifically, the spring is configured in such a way that, in the position of use, the immobilizing catches are in elastic contact with the link rods between the second pivot spindle of the link rods and that portion of the link rods that is in contact with the first pivot spindle 120.

The free end of the tape can then be pressed against the two adjacent sheets of plasterboard, in the corner formed by the two sheets of plasterboard, then the head of the applicator is pressed against the two sheets of plasterboard so that the drive wheels press the tape against the sheets.

The applicator is then moved along such that the drive wheels drive the tape which is paid out, carrying mud with it. At the same time, the corner wheel, borne by the link rods in the position of use, presses the tape into the corner and against the sheets, and does so in any position of inclination of the applicator with respect to the sheets of plasterboard, thanks to the elastic return of the link rods toward the first pivot spindle.

In order to place the head back in the retracted position, the spring is squeezed between the two arms of the spring 140 and at the return arch 145 to retract the immobilizing catches 144 toward the space situated between the two flanks 112*a*-112*b* and allow the link rods to pass and to pivot in the opposite direction to the arrow F1, then the immobilization means are activated to immobilize the link rods in the retracted position. In the embodiment illustrated, this is done by forcing the link rods to pass against the claws 151 until the link rods come into contact with the end stop 152. In this position, the link rods have completely passed against the claws 151 which deploy over the link rods elastically and immobilize the latter, preventing them from pivoting under the effect of gravity.

The application head according to the invention is therefore multifunctional and very simple and quick to use. It requires just three movements to switch from one position to the other, where heads of the prior art require a greater number of movements.

Furthermore, it allows the tape to be pressed down while permitting a wide variety of movements because the link rods (and therefore the corner wheel) are pressed elastically toward the front of the head, namely toward the first pivot spindle 120.

Finally, the structure of the application head allows it to bear means of attachment to the chamber which, furthermore, perform a function of heightwise adjustment of the tape outlet slot 9.

Specifically, the tape outlet slot 9 is formed between a free end of a frontal wall of the chamber and a second free end of the lower wall of the chamber. The height H1 of this slot determines the amount of mud carried by the tape.

Now, it is desirable to be able to alter this amount of mud, according to the conditions of use, the viscosity of the mud, etc.

The invention proposes mechanically coupling to the application head a plate, that is structurally independent of the head and able to slide relative to the slot in order to reduce the resultant height H2 of the slot 9 and thus reduce the amount of mud applied with the tape.

This embodiment, illustrated in FIGS. 9 and 10, takes advantage of the structure of the application head according to the invention and, in particular, the mounting plate.

In these figures, only the elements necessary for understanding this functionality have been illustrated. Of course, the link rods 131, the corner wheel 133, the spring 140 according to the invention, the pivot spindles 120-130, the drive wheels 121, etc., may be added.

The application head 100 according to the invention is intended to be fixed against an exterior contact face 10*b* of the frontal wall 10 of the chamber 4, in a fixing position.

The invention plans for the contact face 10*b* to comprise a sliding guide 14 equipped with an oblong orifice 15. As will be described later, the length of the oblong hole determines the length of sliding travel of the plate and therefore the resultant height H2 of the outlet slot 9.

The chamber further comprises an adjusting plate 16 for adjusting a height H2 of said outlet slot, the adjusting plate 16 being arranged inside the chamber, against the front wall 10 of the chamber.

A coupling and clamping spindle 17 for coupling and clamping the plate 16 is engaged in an orifice 16*a* of the plate 16 and in the oblong hole 15 of the sliding guide 14.

To complement this, the fixing web 111 of the application head comprises a bearing face 111*a* intended to bear against the contact face 10*b* of the frontal wall 10 of the chamber, in a fixing position.

The bearing face 111*a* of the fixing web comprises a sliding end stop 111*b* provided with a hole 115 arranged centrally with respect to the sliding end stop.

The hole 115 is intended to have the coupling and clamping spindle 17 pass through it to fix the application head against the frontal wall of the chamber.

Complementary fixing means are provided to collaborate with the coupling and clamping spindle 17 to allow the fixing web 111 to be clamped against/loosened with respect to the frontal wall 10 of the chamber.

In the preferred embodiment illustrated, the fixing means comprise a quick clamp lever 116 comprising a cam 116*a* fixed eccentrically and such that it can pivot with respect to the axis X-X to a coupling member 117 intended to be fixed to the coupling and clamping spindle. Advantageously, a washer 118 is provided between the coupling member and the fixing web 111 to protect the latter from the friction of the cam 116*a* during clamping/loosening.

In the embodiment illustrated, the sliding end stop 111*b* borne by the bearing face 111*a* of the fixing web 111 consists of an oblong groove intended to collaborate with the sliding guide 114 borne by the contact face 10*b* of the frontal wall 10 of the chamber, the sliding guide 114 being an oblong web of a shape that complements, except in terms of length, the groove 111*b*. In this case, the groove borne by the fixing web will have a length L3, and the rib borne by the chamber will have a length L2 less than the length L3.

Of course, it is possible to reverse the volumes and for the sliding end stop borne by the bearing face of the fixing web to consist of an oblong rib intended to collaborate with the sliding guide borne by the contact face of the frontal wall of the chamber, the sliding guide being an oblong groove. In this case, the groove borne by the chamber will have a length L3, and the rib borne by the fixing web will have a length L2 less than the length L3.

In order to set the height H2 of the outlet slot, the means for tensioning/slackening-off the coupling and clamping spindle are operated in order to loosen the mounting plate and the plate against the frontal wall of the chamber.

To do that, the lever 116 is pivoted in such a way as to position the cam 116*a* a smaller distance away from the washer. This then reduces the clamping tension applied to the coupling and clamping spindle 17.

The mounting plate 110 coupled to the adjusting plate 16 are then slid using the coupling and clamping spindle 17 until the outlet slot for the tape has an operational height H2 corresponding to a datum mud-application output.

The means for tensioning/slackening-off the coupling and clamping spindle are then operated in order to clamp the mounting plate and the plate against the frontal wall of the chamber. In the embodiment illustrated, the lever 116 is pivoted in such a way as to position the axis of rotation X-X of the cam 116*a* at a greater distance from the washer, thereby increasing the clamping tension applied to the coupling and clamping spindle 17.

In one advantageous embodiment, the orifice 16*a* in the plate 16 is polygonal and the coupling and clamping spindle 17 has a polygonal cylindrical portion 17*a* of a shape that complements the polygonal hole 16*a* and that is intended to be inserted in the polygonal hole 16*a* in order to prevent the plate from rotating about the coupling and clamping spindle. That then easily ensures perfect parallelism of the functional edges of the outlet slot 9 during application.

The structure of the application head according to the invention also allows easier adjustment of the height H2. Specifically, adjustment is generally performed when the applicator is set down via its lower face 8 on a support. In this position, it is difficult to see the outlet slot 9.

The invention makes provision for the mounting plate 110 to have a rectilinear distal edge 119, which is to say the edge at the opposite end to the first axis of rotation, that constitutes an adjustment marker against a graduated scale 13 parallel to the rectilinear distal edge 19 and borne by the exterior contact face 10*b* of the frontal wall 10 of the chamber. This scale thus directly represents the outlet slot, so that the user can directly visualize, above the immobilizing head, the measurement of the opening of the outlet slot which is situated below the head and which is not visible when the user is adjusting the height of the outlet slot.

This avoids said user having to turn the applicator over after or during adjustment.

The fixing head 100 according to the invention thus allows heightwise adjustment of the slot, while at the same time being structurally independent of the adjusting plate.

Thus, in the event of plate wear, it is possible to change the plate without having to change the application head.

Furthermore, it means that different materials can be used for the application head and for the plate. The latter is advantageously made of a non-rusting metal which is more resistant to the heat and abrasion of the mud and of the tape than the plastic generally used in the manufacture of the application heads.

According to alternative or complementary embodiments which have not been illustrated:

- the immobilization means 150 may be comprise an immobilization orifice and an immobilization pin intended to be inserted removably into the immobilization orifice. The immobilization orifice is, for example, borne by the flanks 112*a*-112*b* and the immobilization pin is borne by the link rods. The immobilization pin (which may be combined with an elastic return means) is then extracted from the immobilization orifice in order to allow the link rods to be pivoted into the position of use.
- the rectilinear distal edge 119 may be beveled to make the outlet slot height setting easier to read against the graduated scale 13.

The invention claimed is:

1. An application head (100) for an applicator (1) of jointing tape for joining two sheets of plasterboard, the applicator comprising a payout device (2) for paying out a jointing tape (B) that comes in a roll (3) and a mud chamber (4) through which the tape is paid out, the chamber having, a tape inlet slot (6) formed between a free end (7*a*) of a rear wall (7) of the chamber and a first free end (8*a*) of a lower wall (8) of the chamber, and a tape outlet slot (9) formed between a free end (10*a*) of a frontal wall (10) of the chamber and a second free end (8*b*) of the lower wall (8) of the chamber, the chamber further comprising two lateral walls (11-12), one of which constitutes a removable side cover providing access to an inside of the chamber, the application head (100) being intended to be fixed to the frontal wall (10) above the outlet slot, the application head (100) comprising:

- a mounting plate (110) comprising a fixing web (111) equipped with means for fixing the application head against the frontal wall of the chamber, and two flanks (112*a*-112*b*) perpendicular to the fixing web and each having two orifices (113-114), facing each other in pairs, to receive a first rotation spindle (120) and a second rotation spindle (130), which spindles are mutually parallel,
- two toothed wheels (121) that are borne by the first rotation spindle for driving the tape;
- two link rods (131) being mounted via a first end to rotate freely, on the second rotation spindle (130), between a retracted position and a position of use, a second end of each link rod being mounted to rotate freely on a third rotation spindle (132), on either side of a corner wheel (133), itself free to rotate on the third rotation spindle;

the application head (100) being characterized in that it comprises:

- a spring (140) having two legs (141) bearing against the mounting plate, each bearing leg being extended by a bend (142) connected to an immobilizing arm (143) equipped with a catch (144) for immobilizing the link rods in the position of use, the immobilizing arms extending in a plane secant to a plane passing through the two bearing legs, the immobilizing arms being joined together by a return arch (146) extending in a plane secant to the plane passing through the two immobilizing arms
- reversible immobilization means (150, 151-152), independent of the spring, for immobilizing the link rods in the retracted position.

2. The application head (100) as claimed in claim 1, wherein the immobilization means comprise at least one immobilization claw (151) and at least one end stop (152) configured so that, in the immobilization position, at least one link rod is kept pressed against the end stop by the claw.

3. The application head (100) as claimed in claim 2, wherein the claws and/or the link rods are configured to allow the link rods to be forcibly unlocked from the claws.

4. The application head (100) as claimed in claim 1, wherein the immobilization means comprise an immobilization orifice and an immobilization pin intended to be inserted removably into the immobilization orifice.

5. The application head (100) as claimed in claim 1, wherein the return arch is chosen from straight arches or curved arches.

6. The application head (100) as claimed in claim 1, wherein the immobilization catches comprise a lateral locking loop (144*b*) to lock the link rods in the position of use.

7. The application head (100) as claimed in claim 1, intended to be fixed against an exterior contact face (10*b*) of the frontal wall (10) of the chamber, in the fixed position, the contact face comprising a sliding guide (14) equipped with an oblong orifice (15), the chamber further comprising a plate (16) for adjusting the height of the outlet slot, said plate being arranged inside the chamber, and a plate coupling and clamping spindle (17), the plate coupling and clamping spindle being engaged in an orifice (16*a*) of the plate and in the oblong orifice (15) of the sliding guide, the fixing web (111) of the application head comprising a bearing face (111*a*) intended to bear against the contact face of the frontal wall of the chamber, in the fixed position, the bearing face of the fixing web bearing a sliding end stop (111*b*) equipped with a central hole (115) through which the coupling and clamping spindle (17) is intended to pass, and wherein the means for fixing the application head against the frontal wall of the chamber are able to collaborate with the coupling and clamping spindle to allow the fixing web to be clamped against the frontal wall of the chamber, or loosened therefrom.

8. The application head (100) as claimed in claim 7, wherein the fixing means comprise a quick clamp lever (116) comprising a cam (116*a*) fixed in a pivoting and eccentric manner to a coupling member (117) intended to be fixed to the coupling and clamping spindle (17).

9. The application head (100) as claimed in claim 7, wherein the sliding end stop borne by the bearing face of the fixing web comprises an oblong groove intended to collaborate with the sliding guide borne by the contact face of the frontal wall of the chamber, the sliding guide being an oblong rib.

10. The application head (100) as claimed in claim 7, wherein the sliding end stop borne by the bearing face of the fixing web comprises an oblong rib intended to collaborate with the sliding guide borne by the contact face of the frontal wall of the chamber, the sliding guide being an oblong groove.

11. An applicator (1) of jointing tape between two sheets of plasterboard, the applicator comprising a payout device for paying out a jointing tape that comes in a roll and a mud chamber through which the tape is paid out, the chamber having, a rear wall delimiting a tape inlet slot, and a frontal wall delimiting a tape outlet slot, characterized in that the frontal wall of the chamber bears an application head as claimed in claim 1.

12. The applicator (1) as claimed in claim 11, wherein the frontal wall (10) of the chamber comprises an exterior contact face for contact with a bearing face of the application head, the contact face bearing a sliding guide equipped with an oblong orifice, the chamber further comprising a plate for adjusting a height of the outlet slot, said plate being arranged inside the chamber, and a plate coupling and clamping spindle, plate coupling and clamping the spindle being engaged in an orifice in the plate and in the oblong orifice of the sliding guide, wherein the bearing face of the fixing web bears a sliding end stop (111*b*) collaborating and sliding with the sliding guide (14), the sliding end stop being equipped with a central hole through which the coupling and clamping spindle passes, and wherein the means for fixing the application head against the frontal wall of the chamber collaborate with the coupling and clamping spindle to allow the mounting plate and the adjusting plate to be clamped against the frontal wall of the chamber, or loosened therefrom.

13. The applicator (1) as claimed in claim 12, wherein the fixing means comprise a quick clamp lever comprising a cam fixed in a pivoting and eccentric manner to a coupling member fixed to the coupling and clamping spindle.

14. The applicator (1) as claimed in claim 12, wherein the sliding end stop borne by the bearing face of the mounting plate comprises an oblong groove (111*b*) of determined length (L3) collaborating in sliding with the sliding guide borne by the contact face of the frontal wall of the chamber, the sliding guide being an oblong rib (14) of determined length (L2) less than the length (L3) of the oblong groove.

15. The applicator (1) as claimed in claim 12, wherein the sliding end stop borne by the bearing face of the mounting plate comprises an oblong rib of determined length (L2) collaborating in sliding with the sliding guide borne by the contact face of the frontal wall of the chamber, the sliding guide being an oblong groove of determined length (L3) greater than the length (L2) of the oblong rib.

16. A method for applying a jointing tape between two adjacent sheets of plasterboard making a corner-forming angle between them, the method comprising the following steps:

a) providing a jointing-tape applicator as claimed in claim 11, the chamber of the applicator being filled with compound and the tape comprising a free end protruding from the tape outlet slot;

b) if the link rods bearing the corner wheel are in the retracted position, deactivating the link rod fixing means so that they can be pivoted toward the first rotation spindle;

c) squeezing the spring by applying a squeezing force between the two arms of the spring and at a level of the return arch so as to allow the link rods to pivot until the link rods come to bear against the first rotation spindle;

d) positioning the catch for immobilizing the link rods above the link rods then releasing the spring so that the link rods are in a position of use, returned elastically toward the first pivot spindle;

e) pressing the free end of the tape against the two adjacent sheets of plasterboard, in a corner angle formed by the two sheets of plasterboard, then pressing the head of the applicator against the two sheets of plasterboard so that the drive wheels press the tape against the sheets;

f) moving the applicator along so that the drive wheels drive the tape which is paid out, carrying mud out with it, and so that the corner wheel, borne by the link rods in the position of use, presses the tape into the corner in all positions of inclination of the applicator with respect to the sheets of plasterboard, by virtue of the elastic return of the link rods toward the first pivot spindle.

* * * * *